US005440203A

United States Patent [19]

Nakanishi

[11] Patent Number: 5,440,203

[45] Date of Patent: Aug. 8, 1995

[54] ENERGY-VARIABLE RFQ LINAC

[75] Inventor: Tetsuya Nakanishi, Amagasaki, Japan

[73] Assignee: Mitsubishi Denki Kabushiki Kaisha, Tokyo, Japan

[21] Appl. No.: 922,625

[22] Filed: Jul. 30, 1992

[30] Foreign Application Priority Data

Aug. 2, 1991 [JP] Japan ..... 3-193964
May 29, 1992 [JP] Japan ..... 4-138407

[51] Int. Cl.[6] ..... H01J 25/10
[52] U.S. Cl. ..... 315/5.41
[58] Field of Search ..... 315/5.41, 5.34, 5.42, 315/5.43, 5.46, 5.47, 5.44; 328/233; 327/133

[56] References Cited

U.S. PATENT DOCUMENTS

| | | | |
|---|---|---|---|
| 4,490,648 | 12/1984 | Lancaster et al. | 315/5.41 |
| 4,733,132 | 3/1988 | Miyata et al. | 315/5.41 |
| 4,801,847 | 1/1989 | Sakudo et al. | 315/5.41 |
| 5,014,014 | 5/1991 | Swenson | 315/5.41 |
| 5,084,682 | 1/1992 | Swenson et al. | 315/5.41 |
| 5,113,141 | 5/1992 | Swenson | 315/5.34 |
| 5,280,252 | 1/1994 | Inoue et al. | 315/5.41 |
| 5,334,943 | 8/1994 | Sawada | 315/5.41 |

OTHER PUBLICATIONS

Nakahashi, T., et al,. "RFG development at INS", Proceedings of the 5th Symposium on Accelerator Science and Technology, Sep. 26–28, 1984, pp. 89–91.

Tukuda, T., et al, "Structure and RF Characteristics of the INS 25.5-MHz Split Coaxial RFQ", Proceedings of the 7th symposium on Accelerator Science and Technology, Dec. 12–14, 1989, pp. 92–94.

Tokiguchi, K., et al, "Acceleration Experiments of a Variable Energy RFQ Diven by an LC Tank Circuit", Proceedings of the 7th Syposium on Accelerator Science and Technology, Dec. 12–14, 1994, pp. 95–97.

*Primary Examiner*—Willis R. Wolfe
*Attorney, Agent, or Firm*—Wolf, Greenfield & Sacks

[57] ABSTRACT

An energy-variable split coaxial RFQ linac wherein four electrodes thereof are inner conductors in a coaxial cavity, characterized in that a cavity thereof is partitioned by conductive plates, high-frequency powers are independently supplied to respective partitioned cavities and the high-frequency power supplied to the partitioned cavity at an exit side thereof is controlled thereby controlling energy of a beam emitted from the exit side.

36 Claims, 13 Drawing Sheets

ENERGY-VARIABLE RFQ LINAC

BACKGROUND OF THE INVENTION

1. Field of the Invention

The present invention relates to an RFQ linac which for instance, efficiently accelerates a charged particle beam having low energy, and particularly to an energy-variable RFQ linac preferably utilized in an ion implantation device or the like.

2. Discussion of Background

FIGS. 12 and 13 are respectively a sectional diagram and a partially broken side view of a conventional four-vane radio frequency quadrupole cavity which is for instance, described in the Proceedings of the 5th Symposium on Accelerator Science and Technology, p. 89–91, Sep. 26–28, 1984.

In FIGS. 12 and 13, a reference numeral 1 designates a cylindrical cavity which is a resonance cavity, and 2, a vane an end portion of which has a shape wavy in the longitudinal direction thereof. Four pieces of the vanes 2 are arranged on an inner wall face of the cylindrical cavity 1 so that the end portions of pairs of the vanes 2 oppose each other and the pairs are orthogonal to each other, which partition the cylindrical cavity 1 thereby forming four chambers 3. A numeral 4 designates a loop coupler provided at the cylindrical cavity 1, for supplying a high-frequency power into the cylindrical cavity 1, 5, a side tuner made of a cylindrical metal block which is provided at the inner wall face of the cylindrical cavity 1 facing the respective chamber 3 and 6, a driving device for the side tuner 5.

In this discussion, the cylindrical cavity 1 attached with the vanes 2 is called an acceleration cavity, all of which are composed of conductive bodies.

Next, explanation will be given to the operation of the conventional four-vane radio frequency quadrupole cavity (hereinafter, four-vane RFQ cavity).

When alternating voltages having the same polarity are applied to a first pair of the opposing vanes 2, and alternating voltages having the inverse polarity are applied to a second pair of the opposing vanes 2, a quadrupole electric field is generated in an aperture surrounded by the four vanes 2 for passing through the charged particle beam.

The charged particle beam receives a converging force of the quadrupole electric field and receives acceleration by an electric field generated in the proceeding direction of the charged particle beam owing to the wave shape of the end portions of the vanes 2.

The wave period of the end portion of the vane 2 is necessary to be a value which is proportional to a product of the wavelength of the alternating voltage by a beam speed, which is fabricated so that the period is prolonged with the acceleration of the beam.

Accordingly, once the vane 2 is fabricated, the speed of the beam emitted from the exit side of the cavity is determined by the frequency of the alternating voltage. Therefore, the only way to change energy of the beam emitted from the exit side of the cavity with respect to arbitrary charged particles, is changing the frequency of the alternating voltage.

The supply of the high-frequency power to the acceleration cavity is performed through the loop coupler 4. A magnetic field generated by the loop coupler 4 proceeds in the longitudinal direction of the acceleration cavity in the chamber 3 partitioned by the vanes 2, and towards the juxtaposed chambers 3 through a space at an end portion of the acceleration cavity, and returns. At this moment, a strong electric field is generated in a gap at the end portions of vanes 2. At the same time, an electric field is also generated at end portions of the opposing vanes 2 since electric charge is induced. As a result, the above alternating voltage is generated among the vanes 2.

To supply efficiently the high-frequency wave to the acceleration cavity, it is necessary to conform the frequency of the high-frequency wave to a resonance frequency of the acceleration cavity. A resonance frequency is determined by a product of a capacitance C by an inductance L both of which are connected in parallel in a general electric circuit, which is given by $2\pi f_r=(LC)^{-\frac{1}{2}}$.

In this acceleration cavity, it is equivalently considered that an inductance L which is proportional to a sectional area of the chamber 3 and an intervane capacitance C are connected in parallel. Accordingly, when the frequency of the high-frequency wave is determined, it is necessary to determine a gap length between the vanes 2 and the sectional area of the chamber 3 so that the frequency agrees with a frequency of the cavity resonator.

Generally, the gap length between the vanes 2 is determined so that a high-density electric field is generated by a lowest possible voltage. Therefore, the sectional area of the chamber 3 is determined by the capacitance C which is determined by the above procedure, to obtain the necessary resonance frequency.

By extending the side tuner 5 into the chamber 3 and retracting it therefrom by the driving device 6, a space volume of the chamber 3 is changed thereby changing the inductance L. Therefore, the side tuner 5 is capable of changing the resonance frequency, and is used for adjustment of the resonance frequency and adjustment of an electromagnetic field distribution. In the above explanation, when the section of the cavity is not uniform in the longitudinal direction, the above factor should be considered as a space volume of the chamber 3. In this adjustment, the maximum changeable width of the resonance frequency is about 1%, which is an adjustment width for conforming the resonance frequency varied by a fabricating error of the acceleration cavity or the like, to a design value.

FIG. 14 is a longitudinal sectional diagram of a simplified structure of a conventional split coaxial RFQ cavity which is presented for instance, in the Symposium on Accelerator Science and Technology, 1989, FIG. 15, a sectional diagram taken along the line XV–XV of FIG. 14, and FIG. 16, a sectional diagram taken along the line XVI–XVI of FIG. 14. In these Figures, a numeral 7 designates an electrode the shape of the end portion of which is wavy in the longitudinal direction. In the cylindrical cavity 1, ends of a first pair of the electrodes 7 are electrically connected to an inner end face of the cylindrical cavity. The first pair of electrodes are opposingly arranged with respect to the axial line and extended in the axial direction, and shortcircuited to and supported by an inner wall face of the cylindrical cavity 1 by a stem **8*b*. Ends of a second pair of the electrodes 7 are electrically connected to the other inner end face of the cylindrical cavity 1. The second pair of the electrodes 7 oppose each other with respect to the axial line of the cylindrical cavity 1 and orthogonal to the first pair of the electrodes 7, extended in the axial direction of the cavity, and shortcircuited to and supported by the inner wall face of the cylindrical cavity by a stem 8***a*. Accordingly, this cylindrical cavity 1 is partitioned into three cavities by the stems 8*a* and 8*b*, and is equivalent to a structure wherein three split coaxial cavities are connected.

The cylindrical cavity 1 attached with electrodes 7 is called an acceleration cavity, all of which are constructed by conductive bodies.

Next, explanation will be given to the conventional split coaxial RFQ cavity.

When alternating voltages having the same polarity are applied to the first pair of the opposing electrodes 7, and alternating voltages having the inverse polarity are applied to the second pair of the electrodes 7, a quadrupole electric field is generated in an aperture surrounded by the four electrodes 7 for passing the beam. The beam receives a converging force by the quadrupole electric field, and also receives acceleration by a component of an electric field in the proceeding direction of the beam owing to the wavy shape of the end portions of the electrodes 7.

It is necessary to conform the period of the wave of the end portion of the electrode 7 to a value which is proportional to a product of the wavelength of the alternating voltage by the beam speed, and is fabricated so that the period is prolonged with the acceleration of the beam. Accordingly, once the electrode 7 is fabricated, the beam speed is determined by the frequency of the alternating voltage. Therefore, the energy of the beam emitted from the exit side of the cavity, is determined.

As a way of applying the alternating voltage to the electrode 7, a system is utilized wherein a high-frequency power is applied to the acceleration cavity, to rise a standing wave (resonant state). This system can efficiently supply power. Hereinafter, explanation will be given to why the above voltage is generated at the four electrodes 7 in the split coaxial cavity, and how the electromagnetic field is generated.

FIGS. 17(*a*) and 17(*b*) show a reentrant type cavity which is generally utilized for accelerating the charged particles. An outer conductive body 21 is equivalent to the cylindrical cavity 1, and an inner conductive body 22 is equivalent to the electrodes 7. In this cavity, the inner conductive body 22 disposed in the outer conductive body 21 of the cylindrical cavity, is separated at its center, by which an electric field is concentrated in a gap thereof, and the particles are accelerated by the electric field. The distribution of the electric field and the magnetic field and a path of a surface current are shown in the drawings. A potential difference between the separated portions of the inner conductive body 22 is uniform throughout the section of the cylinder of the inner conductive body 22.

FIGS. 18(*a*) and 18(*b*) show a modified example of the reentrant type cavity. In this cavity, a configuration for separating the inner conductive body 22 is changed thereby enlarging a domain capable of generating a strong electric field. Both the distribution of the electromagnetic field, and the path of the surface current are the same as those in the above reentrant type cavity, and the potential difference between the separated portions the inner conductive body 22 is uniform.

FIGS. 19(*a*) and 19(*b*) show a structure wherein one more pair of the separated portions of the inner conductive body 22 are added thereto. As shown in the electromagnetic field and the current path in the cavity structure combined with three cavities in FIG. 14, the inner conductive body 22 separated in two pairs, is equivalent to the electrodes 7. The voltages between the electrodes 7 become voltages necessary for generating the quadrupole electric field explained as above and are constant in the beam proceeding direction.

As stated above, the conventional split coaxial RFQ shown in FIG. 14 is equivalent to the structure wherein the three split coaxial cavities shown in FIG. 19 are connected. The connecting portions have structures shown in FIGS. 15 and 16, because a single vacuum pump will do for maintaining the inside of the cavity in vacuum, and, when a high-frequency power is supplied from one position, the high-frequency wave is easily propagated throughout the cavity. Even without these connecting portions, the same voltage distribution as in the above split structure can be obtained. However, since the electrode 7 is supported at one position, when it is elongated, it becomes mechanically unstable and not practical. Therefore, generally, to stabilize the electrode, a reinforcement 9 is attached to the electrode 7 as shown in FIGS. 20(*a*) and 20(*b*).

To efficiently supply the high-frequency power to the acceleration cavity, it is necessary that the frequency of the high-frequency wave agrees with the resonance frequency of the acceleration cavity. In a general electric circuit, the resonance frequency is determined by a product of a capacitance C by an inductance L which is parallelly connected thereto, as $2\pi f_r=(LC)^{-\frac{1}{2}}$.

In this acceleration cavity, the capacitance C is given as a sum of an intervane capacitance $C_{VV}$ and a vane-stem capacitance $C_{VS}$ between the electrode 7 and the stem 8. The inductance L is obtained from a tank inductance $L_T$ obtained by a magnetic field surrounding the electrode 7 and $L_s$ obtained by a magnetic field surrounding the stem 8 by the following equations.

$$L=(L_T/3).(L_T+3L_S)/\{L_T+(L_S/3)\}$$

$$L_T=(\mu 0/2\pi).1_m.1n(r_E)$$

where $l_m$ is a length of the electrode partitioned by the stem 8, $r_C$, an inner radius of the cylindrical cavity 1, and $r_E$, an effective radius of the electrode 7. Accordingly, when the frequency of the high-frequency wave is determined, a gap length between the electrodes 7 and a sectional area of the cylindrical cavity 1 should be determined so that it agrees with the frequency of the acceleration cavity. Generally, the gap between the electrodes is determined so that a high electric field is generated by the lowest possible voltage. Therefore, the sectional area of the chamber is determined by the capacitance C determined by the above procedure to obtain the necessary resonance frequency.

However, when the cavity is actually fabricated, the resonance frequency is slightly deviated since there always is a fabricating error. To correct the error, generally, the side tuner 5 made of a metal block is attached to the cavity as in the conventional four-vane RFQ shown in FIG. 12, by which the resonance frequency is finely controlled by equivalently changing $L_T$ by pushing in and pulling out the side tuner 5. In this adjustment method, the maximum changeable width of the resonance frequency is about 1%.

As stated above, in the conventional four-vane RFQ and the conventional split coaxial RFQ, the speed, or the energy of the beam emitted from the exit side of the cavity can not considerably be changed. Therefore, they are used as a primary stage of a high energy accelerator utilized in an atomic nucleus experiment wherein the energy is not necessary to be varied.

Since the conventional four-vane RFQ and the conventional split coaxial RFQ are constructed as above, the speed or the energy of the beam emitted from the cavity can not considerably be changed. Therefore, these devices are not applicable to an ion implantation device wherein the energy is required to be considerably variable with respect to the same charged particle.

SUMMARY OF THE INVENTION

It is an object of the present invention to provide an energy-variable four-vane RFQ linac and an energy-variable split coaxial RFQ linac capable of arbitrarily changing energy of a beam emitted from a cavity.

According to a first aspect of the present invention, there is provided an energy-variable split coaxial RFQ linac wherein four electrodes thereof are inner conductors in a coaxial cavity, characterized in that a cavity thereof is partitioned by conductive plates, high-frequency powers are independently supplied to respective partitioned cavities and the high-frequency power supplied to the partitioned cavity at an exit side thereof is controlled thereby controlling energy of a beam emitted from the exit side.

According to a second aspect of the present invention, there is provided an energy-variable split coaxial RFQ linac wherein four electrodes thereof are inner conductors in a coaxial cavity, characterized in that energy of a beam emitted from an exit side thereof can be varied by changing effective lengths of the four electrodes by a shortcircuit plate for shortcircuiting the inner conductors with outer conductors.

According to a third aspect of the present invention, there is provided the energy-variable split coaxial RFQ linac according to the second aspect, wherein a quadrupole electromagnet is installed at an exit side of a cavity thereof.

According to a fourth aspect of the present invention, there is provided an energy-variable four-vane RFQ linac attached with four electrodes (vanes) at angular intervals of 90° in a resonance cavity thereof having a square or circular sectional shape, characterized in that the resonance cavity is partitioned by thin partition plates, high-frequency powers are supplied to respective partitioned cavities and the high-frequency power supplied to the partitioned cavity at an exit side thereof is controlled thereby controlling energy of a beam emitted from the exit side.

According to a fifth aspect of the present invention, there is provided a four-vane RFQ linac attached with four electrodes (vanes) at angular intervals of 90° in a resonance cavity thereof having a square or circular sectional shape characterized in that metal plates composing ground electrodes are inserted into four chambers partitioned by the four vanes and disposed adjacent to end portions of the four vanes thereby increasing and making variable an equivalent capacitance of the resonance cavity.

According to a sixth aspect of the present invention, there is provided a four-vane RFQ cavity attached with four vanes in a resonance cavity so that the four vanes are orthogonal each other in a section of the resonance cavity, characterized in that electric-sectional-area-variable means are provided in respective four chambers partitioned by the four vanes, for changing respective electric sectional areas of the four chambers uniformly in the longitudinal direction of the four chambers.

DETAILED DESCRIPTION OF THE PREFERRED EMBODIMENTS

EXAMPLE 1

Figure 1:
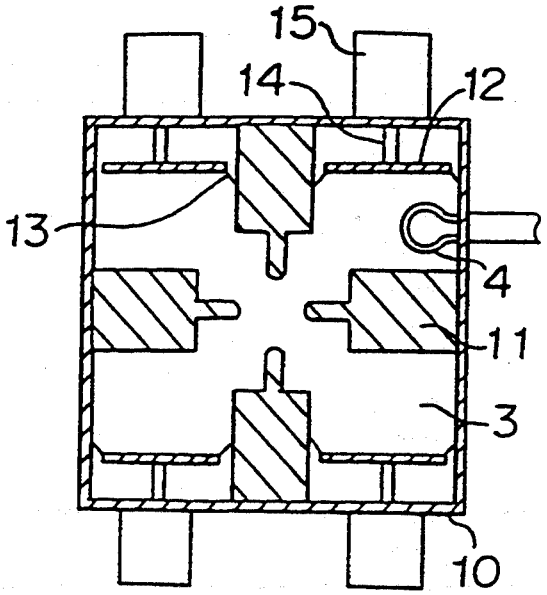
FIG. 1 is a longitudinal sectional diagram showing an embodiment 1 of an energy-variable four-vane RFQ cavity according to the present invention.
Figure 2:
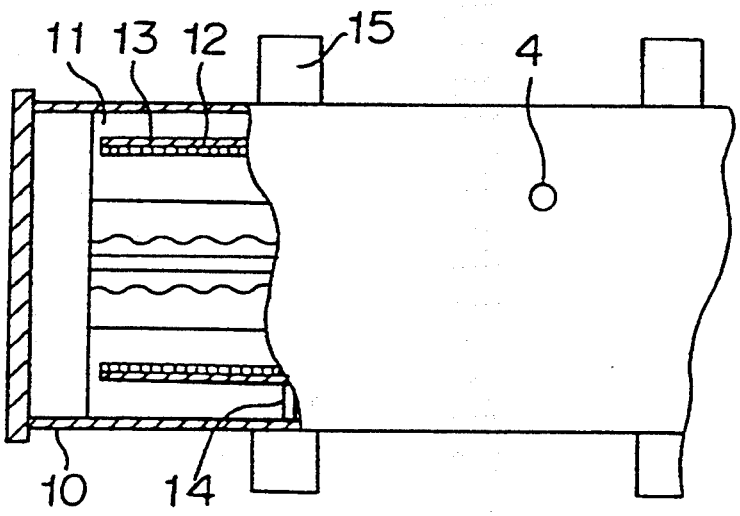
FIG. 2 is a partially broken side view of an embodiment 1 of an energy-variable four-vane RFQ cavity according to the present invention.
Figure 12:
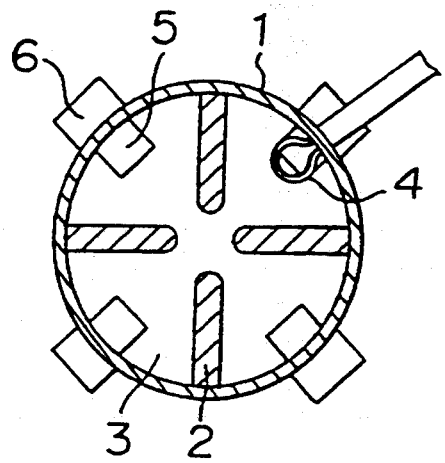
FIG. 12 is a longitudinal sectional diagram showing an example of a conventional four-vane RFQ cavity.
Figure 13:
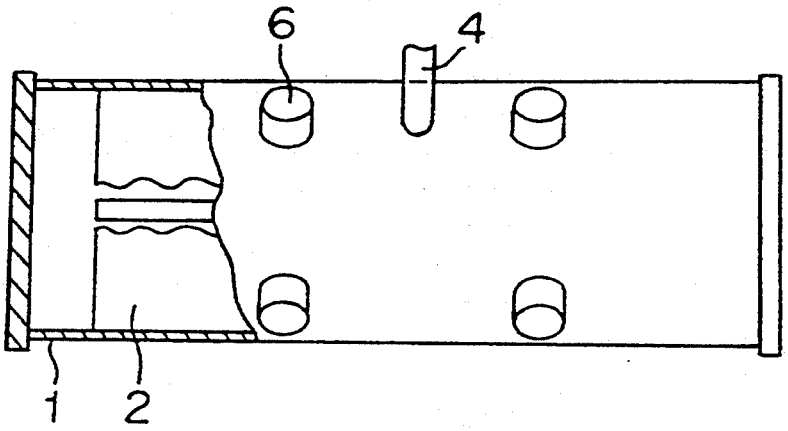
FIG. 13 is a partially cut side view showing an example of a conventional four-vane RFQ cavity.
Figure 14:
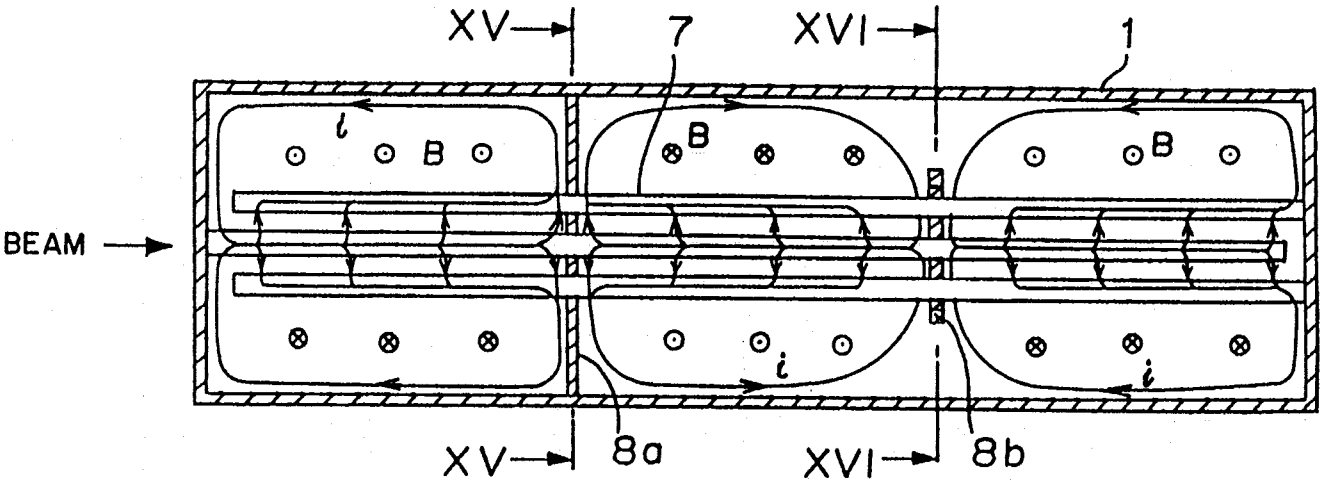
FIG. 14 is a transverse sectional diagram showing an example of a conventional split coaxial RFQ cavity.
Figure 16:
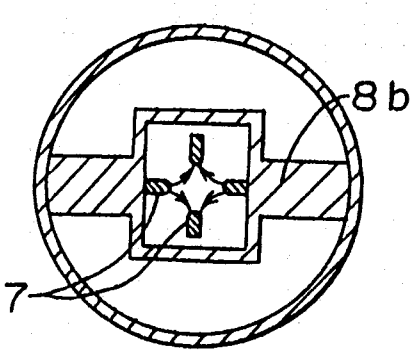
FIG. 16 is a sectional diagram taken along the line XVI—XVI of FIG. 14.
Figure 15:
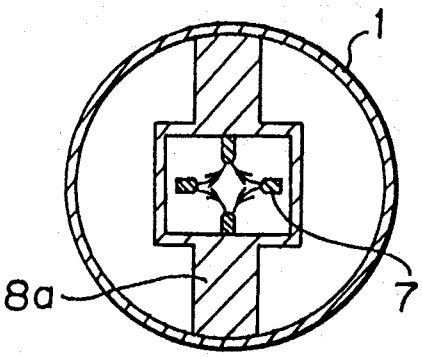
FIG. 15 is a sectional diagram taken along the line XV—XV of FIG. 14.
Figure 17A:
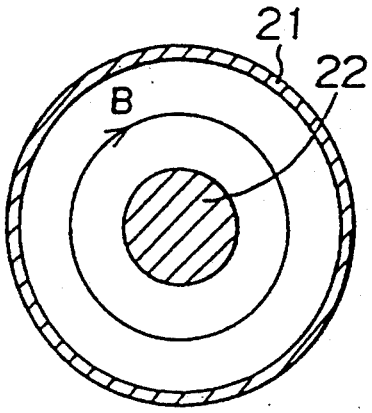
FIGS. 17(*a*) and 17(*b*) are a longitudinal sectional diagram and a transverse sectional diagram for explaining a principle of a split coaxial cavity.
Figure 17B:
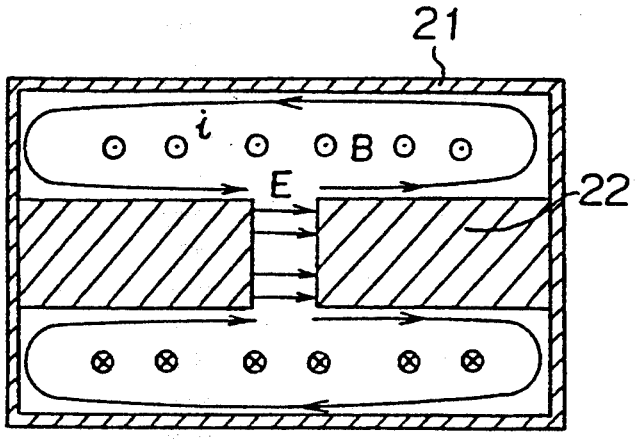
Figure 18A:
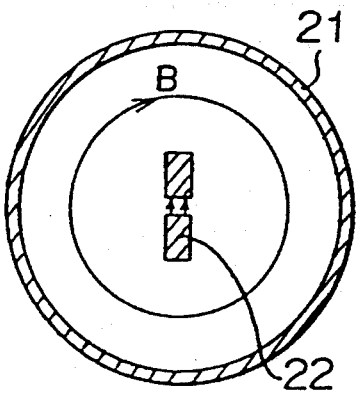
FIGS. 18(*a*) and 18(*b*) are respectively a longitudinal sectional diagram and a transfer sectional diagram for explaining the principle of the split coaxial cavity.
Figure 18B:
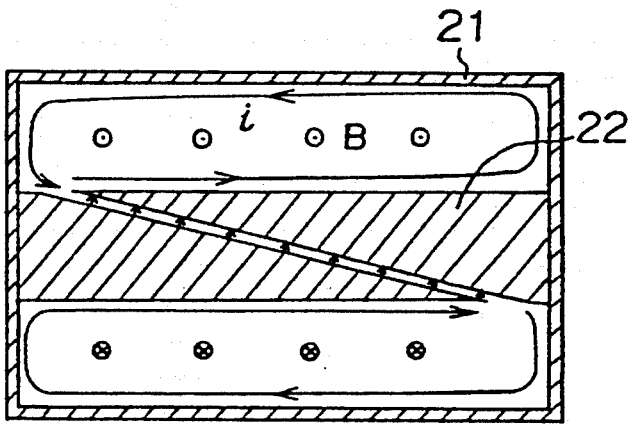
Figure 19B:
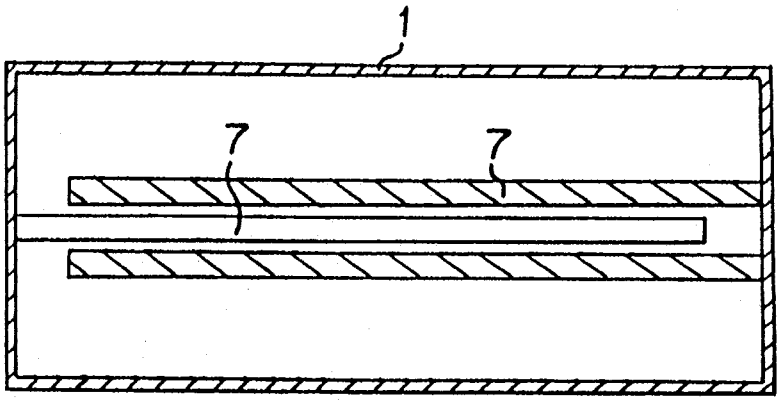
FIGS. 19(*a*) and 19(*b*) are respectively a longitudinal sectional diagram and a transverse sectional diagram of a four-electrode cavity for explaining the principle of a split coaxial cavity.
Figure 19A:
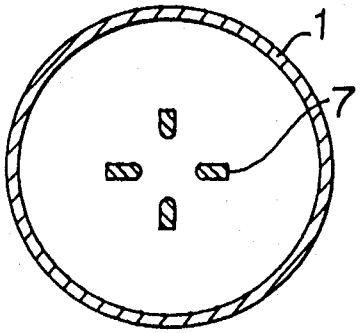
Figure 20B:
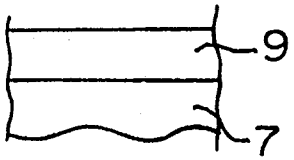
FIGS. 20(*a*) and 20(*b*) are respectively a front view and a side view showing an example of a configuration of an electrode which is utilized in the split coaxial cavity.
Figure 20A:
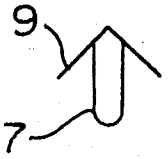

FIGS. 1 and 2 are respectively a sectional diagram and a partially broken side view of an embodiment 1 of an energy-variable four-vane RFQ cavity according to the present invention. In FIGS. 1 and 2, the same or the corresponding portions with those of the conventional four-vane RFQ shown in FIGS. 12 and 13 are attached with the same notations and the explanation will be omitted.

In FIGS. 1 and 2, a reference numeral 10 designates a cavity having a rectangular section composed of conductive bodies which is a resonance cavity, 11, a vane composed of a conductive body the end portion of which is thinned, the root of which is thickened, and the shape of the end portion of which is wavy in the longitudinal direction. Four pieces of the vanes 11 are arranged at an inner wall face of the cavity 10 so that the end portions of the vanes oppose each other with respect to the axial line of the cavity 10 and pairs of the vanes are orthogonal to each other in a section of the cavity 10, and partitions the cavity 10 thereby forming four chambers 3.

A reference numeral 12 designates a shortcircuit plate composing of a conductive body having a length thereof which is approximately equal to a length of the vane 11 that is arranged in the respective chamber 3. This shortcircuit plate 12 electrically and uniformly contacts the cavity 10 by an RF contact 13, and supported by several supporting rods 14 extendably and retractably attached to the cavity 10. A numeral 15 designates a driving device provided outside of the cavity 10, which moves the shortcircuit plate 12 uniformly in the longitudinal direction of the chamber 3 by simultaneously extending and retracting the rods 14 by the driving device 15. The shortcircuit plates 12, the supporting rods 14 and the driving devices 15 constitute a sectional-area-variable means.

Next, explanation will be given to the operation of the embodiment 1.

First, by operating the driving devices 15, extending and retracting quantities of the respective supporting rods 14 are uniformly controlled in pushing in and pulling out the respective supporting rods 14. The shortcircuit plates 12 move uniformly in the longitudinal direction of the chambers 3 since the extending and retracting quantities of the respective supporting rods 14 are uniformly controlled, thereby uniformly changing the sectional areas of the respective chambers 3 in the longitudinal direction. Furthermore, the moving lengths of the respective shortcircuit plates 12 are the same to keep a symmetry of the quadrupole electric field in the aperture.

With the move of the shortcircuit plates 12, the domain capable of passing the magnetic field changes, and as a result, the equivalent inductance L of the acceleration cavity changes.

The other operation of the embodiment 1 is the same with that of the conventional four-vane RFQ shown in FIGS. 12 and 13.

According to the above embodiment 1, compared with the conventional side tuner 5, the inductance L of the acceleration cavity can considerably be changed, the resonance frequency can considerably be changed, and the energy can considerably be changed for the same charged particle.

Furthermore, according to the embodiment 1, since the shape of the end portion of the vane 11 is thin, the cavity 10 can be downsized. Since the root of the vane 11 is thick, the vane 11 can be attached to the inner wall of the cavity 10 accurately and simply.

Furthermore, explanation has been given to the embodiment 1 using the cavity 10 having a rectangular section as a resonance cavity so that the way of changing the electrical sectional area of the respective chamber 3 is simplified. However, this invention has a similar effect by using the cylindrical cavity 1.

Furthermore, explanation has been given to the embodiment 1 using the shortcircuit plates 12, the supporting rods 14 and driving devices 15 as a sectional-area-variable means for changing the electric sectional area of the chamber 3. However, this invention is not limited to this example, so far as the sectional areas of the chambers 3 can uniformly be changed in the longitudinal direction of chamber 3.

EXAMPLE 2

Figure 3:
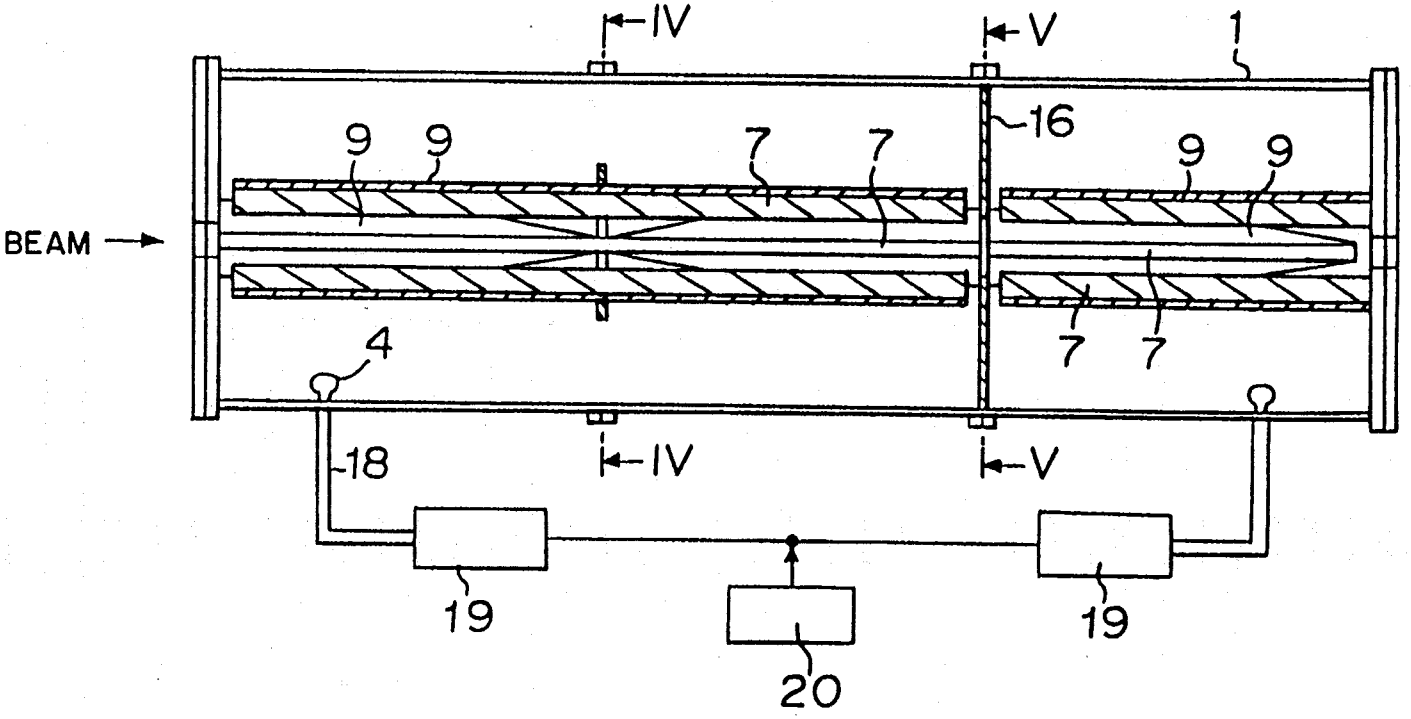
FIG. 3 is a sectional diagram showing an embodiment 2 of an energy-variable split coaxial RFQ cavity according to the present invention.
Figure 4:
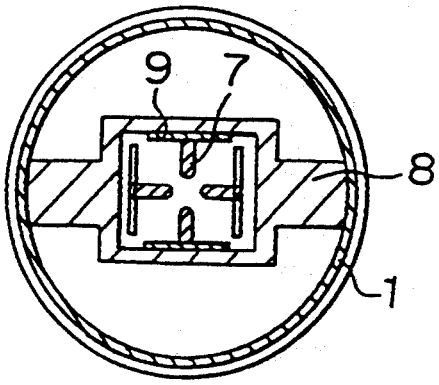
FIG. 4 is a sectional diagram taken along the line IV—IV of FIG. 3.
Figure 5:
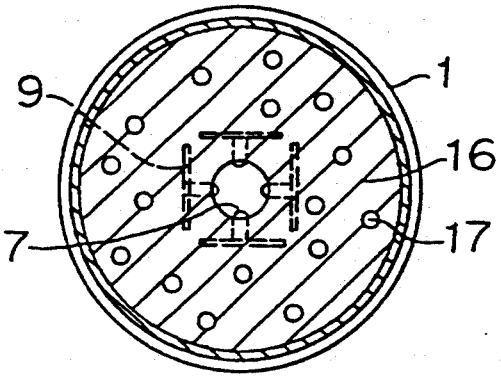
FIG. 5 is a sectional diagram taken along the line V—V of FIG. 3.

FIG. 3 is a transverse sectional diagram showing an embodiment 2 of an energy-variable split coaxial RFQ cavity according to the present invention, FIG. 4, a sectional diagram taken along the line IV—IV of FIG. 3, FIG. 5, a sectional diagram taken along the line V—V of FIG. 3. In these Figures, the same or the corresponding portion with the portion in the conventional split coaxial RFQ shown in FIGS. 14 through 20 is attached with the same notation and the explanation is omitted.

In these Figures, a reference numeral 16 designates a thin partition plate for electrically partitioning the circular cylinder 1, 17, circulating holes provided at the partition plate 16 for enhancing a vacuum conductance between cavities partitioned by the partition plate 16, 18, a coaxial waveguide connected to the loop coupler 4 installed at a partitioned cavity partitioned by the partition plate 16, 19, a high-frequency power amplifier and 20, a signal generator.

Explanation will be given to a cavity structure of the embodiment 2.

The partition plate 16 is installed at a predetermined position in the cylindrical cavity 1. In the circular cavity 1 from an entry side of the beam to the partition plate 16, a first pair of the electrodes 7 oppose each other with respect to the axial line of the cylindrical cavity 1, ends of which are shortcircuitted to and supported by an inner end face at the entry side of the cylindrical cavity 1, and the other ends of which are shortcircuitted to and supported by the partition plate 16. Furthermore, a second pair of the electrodes 7 oppose each other with respect to the axial line of the cylindrical cavity 1, orthogonal to the first pair of the electrodes 7, and are shortcircuitted to and supported by the inner wall face of the cylindrical cavity 1 to an inner wall face of the cylindrical cavity by a stem 8 at their central portions. Furthermore, in the cylindrical cavity 1 from the partition plate 16 to an exit side of the beam, a third pair of the electrodes 7 oppose each other with respect to the axial line of the cylindrical cavity 1, ends of which are shortcircuited to and supported by the partition plate 16. Furthermore, a fourth pair of electrodes 7 oppose each other with respect to the axial line of the cylindrical cavity 1, orthogonal to the third pair of the electrodes 7, ends of which are shortcircuitted to and supported by an inner end face at the exit side of the cylindrical cavity 1.

Accordingly, the cylindrical cavity 1 is partitioned into three cavities by the stem 8 and the partition plate 16, which is equivalent with a structure wherein three split coaxial cavities are connected. The electromagnetic field and the current path in the respective cavities are the same as those shown in FIG. 14.

Furthermore, in the cavities at the entry side and the exit side of the beam, the loop couplers 4 are respectively provided. The necessary frequency is generated by the signal generator 10, which is amplified by the two high-frequency power amplifiers 19, and high-frequency powers are individually supplied through the coaxial waveguides 18 and the loop couplers 4.

The partition plate 16 is provided with the circulation holes 17, which enhance a vacuum conductance between the partitioned cavities.

Next, explanation will be given to the operation of the embodiment 2. Basically, the operation principle is the same with that in the conventional technology. However, the energy of the emitted beam is made variable by changing the inter-electrode voltage in this example. First, explanation will be given to the acceleration principle.

In accelerating the beam, the incident beam has a limited length even if it has previously been bunched. Therefore, the acceleration voltage is different with respect to the particle in the respective cell (length between a projection and a recess of the wavy vane). Accordingly, in contrast to a particle which is accelerated as designed (synchronized particle), the other particles become gradually different from the synchronized particle with respect to their energies.

When an acceleration phase ($o_s$) of a high-frequency wave with respect to the synchronized particle is set between $-90°$ to $0°$ of a cosine wave, particles other than the synchronized particle are accelerated vibrating around the synchronized particle in respect of energy and phase. A locus described by an outermost particle on a phase-energy plane is called a separatorix. Particles outside of the separatorix are emitted out of the cavity without acceleration as a result, since in proceeding the cell, the particles pass through in a deceleration phase because the particle do not perform the phase vibration. The separatorix has its maximum value at $o_s=-90°$ (however, not accelerated on an average), and extinguishes at $o_s=0°$. Accordingly, at $o_s=0°$, although the synchronized particle accelerates most efficiently, particles around the synchronized particle repeat the acceleration and deceleration and the acceleration voltage becomes 0 on an average.

Figure 11:
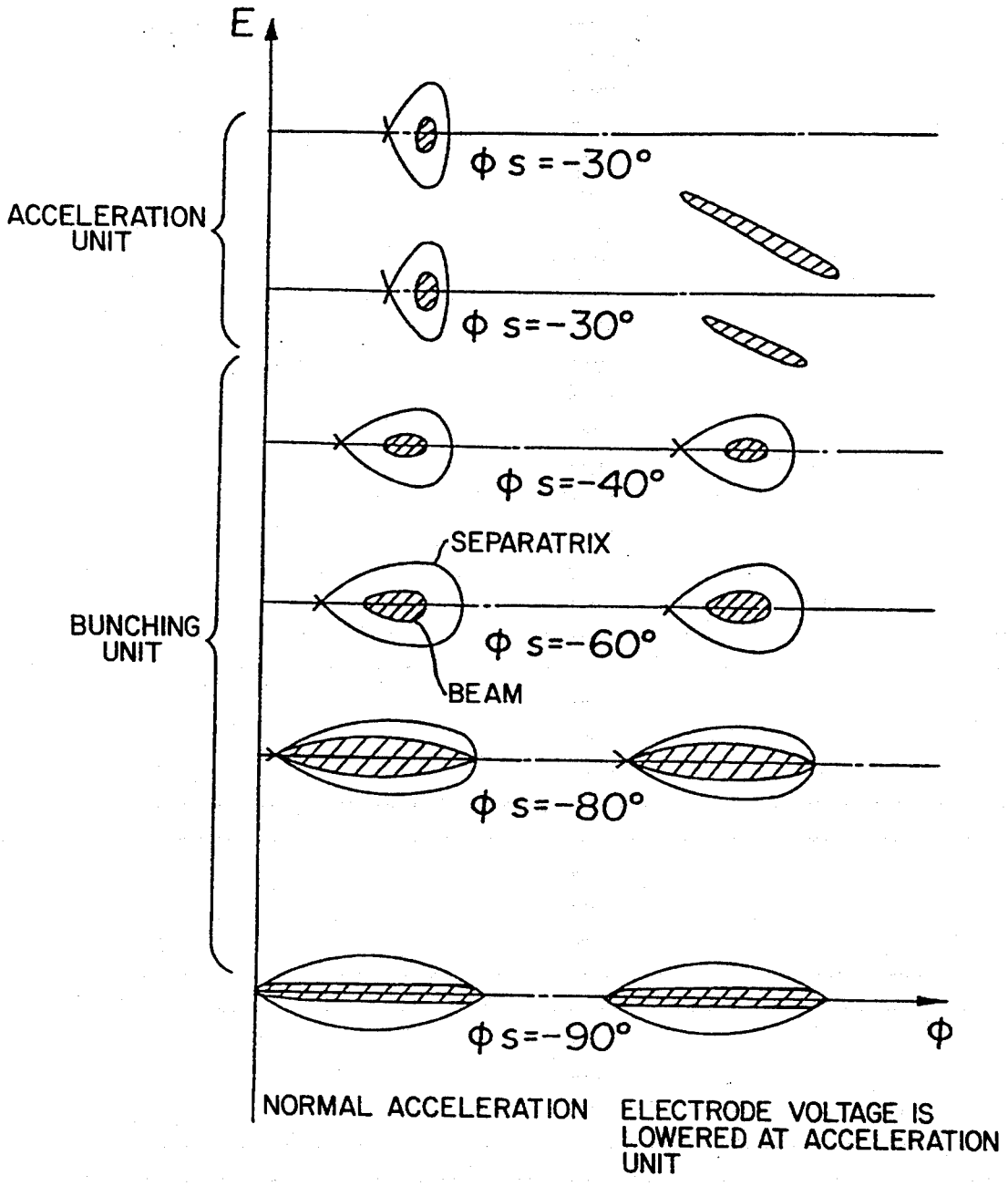
FIG. 11 is an explanatory diagram showing a beam in an acceleration cavity being bunched and accelerated.

In the RFQ linac, generally, a continuous beam is transmitted therein, bunched in acceleration ($o_s=90°$ at first and gradually approaches to a final value), and after $o_s$ reaches the final value, the beam is accelerated with a constant $o_s$. The domain wherein $o_s$ is constant is called an acceleration unit. In this system, more particles can be accelerated. The behavior is shown in FIG. 11. An abscissa of this diagram is the phase of a high-frequency wave, an ordinate thereof, the energy thereof. It is found from this diagram that the continuous beam is bunched in acceleration. Furthermore, the bunched beam has a certain energy width due to the phase vibration.

At this moment, when the acceleration voltage is deviated from a design value, $o_s$ changes. When the acceleration voltage is elevated, $o_s$ changes in the direction of 90°, and when lowered, to the direction of 0°. Accordingly, when the acceleration voltage becomes too low, the separatorix will be extinguished.

In the above embodiment 2, the electrodes 7 are separated at the position of the partition plate 16 and the acceleration cavity is separated in respect of high-frequency. The electrode voltages can independently be controlled on the upstream side (entry side) and on the downstream side (exit side). In the conventional split coaxial RFQ shown in FIG. 14, even if the stem 8*b* were enlarged to cover the whole sectional area of the cavity, since the electrodes 7 are connected, the independent control could not be performed.

When the electrode voltage on the upstream side is set to a design value, and when the electric voltage on the downstream side is lowered to a degree wherein the separatorix is extinguished, the bunching gradually prevails with proceeding thereof cell by cell and the energy is lowered compared with a set value, as shown in FIG. 11. These quantities are different depending on the electrode voltage on the downstream side. Therefore, it is possible to change the energy of the emitted beam by controlling the high-frequency power which is supplied to the downstream side cavity. Furthermore, since the partitioned cavities are connected in a large vacuum conductance, a single vacuum pump can create vacuum, and since the boundary is made of the thin partition plate 16, the device is inexpensive and compact.

At this point, the length of the electrode at the downstream side is preferably to be shorter than a length corresponding with a cycle of the phase vibration in the design value. Because, when the electrode is too long, in case that the separatorix is extinguished, the particles repeat the acceleration and deceleration, and as a result, the acceleration voltage receiving from the electrode at the downstream side becomes zero on an average. Accordingly, the energy of the emitted beam becomes equal to the energy at the exit side of the electrode on the upstream side even if the voltage of the electrode on the downstream side is changed.

Furthermore, in the above embodiment 2, explanation has been given wherein the two high-frequency power amplifiers 19 are provided. However, this invention is not restricted by the number of the power amplifiers. The similar effect can be obtained when the high-frequency powers supplied to the respective acceleration cavities are independently controlled.

Furthermore, in the above embodiment 2, explanation has been given to a construction wherein three split coaxial cavities are equivalently connected. However, the similar effect can be obtained if the number of the cavities is equal to two or more.

EXAMPLE 3

Figure 6:
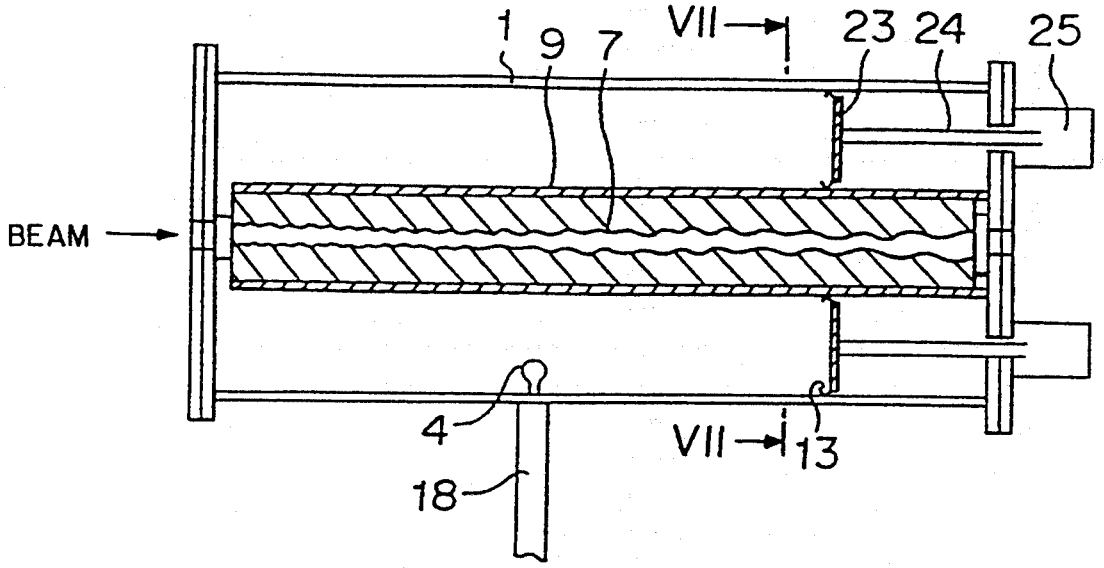
FIG. 6 is a sectional diagram showing an embodiment 3 of an energy-variable split coaxial RFQ cavity according to the present invention.
Figure 7:
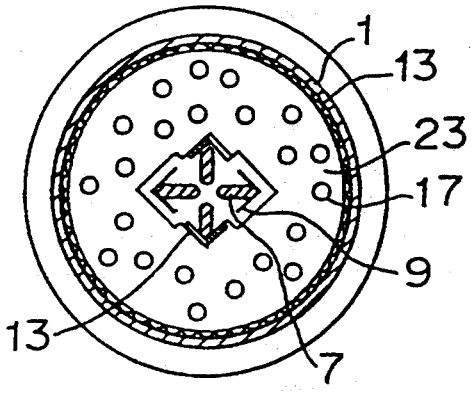
FIG. 7 is a sectional diagram taken along the line VII—VII of FIG. 6.
Figure 8A:
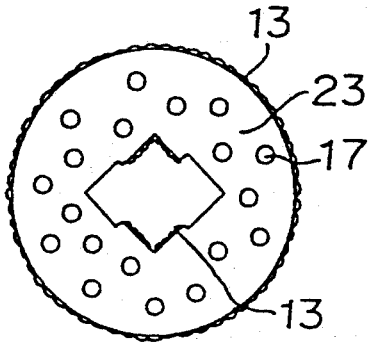
FIGS. 8(*a*) and 8(*b*) are a front view and a side view of a shortcircuit plate showing an embodiment 3 of an energy-variable split coaxial RFQ cavity according to the present invention.
Figure 8B:
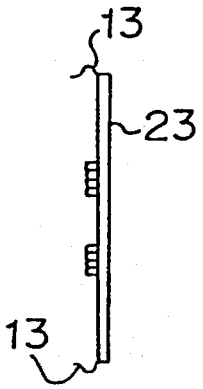

FIG. 6 is a sectional view of an embodiment 3 of an energy-variable split coaxial RFQ, FIG. 7, a sectional view taken along the line VII—VII of FIG. 6, FIGS. 8(*a*) and 8(*b*), respectively a front view and a side view of a shortcircuit plate in the embodiment 3. In these Figures, a numeral 23 designates a shortcircuit plate for shortcircuiting a pair of the electrodes 7 with the inner wall face of the cylindrical cavity 1. This shortcircuit plate 23 is provided with an RF contact 13 to improve electrical contact thereof with the electrodes 7 and the cylindrical cavity 1, and also provided with circulation holes 17 to enhance the vacuum conductance. A numeral 24 designates supporting rods for supporting the shortcircuit plates 23, and 25, driving devices for moving the shortcircuit plate 23 through the supporting rods 24 in the axial direction of the cylinder cavity 1.

In the above embodiment 3, ends of a first pair of the electrodes 7 are attached to an inner end face on the entry side of the cylindrical cavity 1. The first pair of the electrode oppose each other with respect to the axial line thereof and extended in the axial direction. Furthermore, ends of a second pair of the electrodes 7 are attached to an inner end face on the exit side of the cylindrical cavity 1. The second pair of the electrodes 7 are opposing each other with respect to the axial line, orthogonal to the first pair of the electrodes 7, extending in the axial line. The four electrodes 7 are constructed to be equivalent to an inner conductive body of a coaxial cavity. Furthermore, the loop coupler 4 for supplying the high-frequency power, is attached to the cylindrical cavity 1. The second pair of the electrodes 7 attached to the inner end face on the exit side of the cylindrical cavity 1, and the inner wall face of the cylindrical cavity 1 are electrically shortcircuited by the shortcircuit plate 23.

In the embodiment 3 constructed as above, since the second pair of the electrodes 7 attached to the inner end face on the exit side of the cylindrical cavity 1 and the inner wall face of the cylindrical cavity 1 is electrically shortcircuited by the shortcircuit plate 23, this shortcircuiting is equivalent to an operation wherein the inner end face on the exit side of the cylindrical cavity 1 is moved to the position of the shortcircuit plate 23. The cavity downstream from the shortcircuit plate 23 does not constitute the split coaxial cavity. That is to say, there is no electromagnetic field downstream from the shortcircuit plate 23. The electromagnetic field distribution in the acceleration cavity is uniform in the longitudinal direction of the cavity, as explained above. The uniformity does not change by moving the shortcircuit plate 23. The strength of the electromagnetic field which the beam receives is the same up to the position of the shortcircuit plate 23. On the downstream side of the position of the shortcircuit plate 23, the beam is not accelerated, since there is no electromagnetic field. Accordingly, the energy of emitted beam can be changed by adjusting the position of the shortcircuit plate 23.

When there is no electric field, the beam diverges and the beam size gradually increases. Accordingly, it is effective to design the electrodes so that the aperture surrounded by the four electrodes 7 for passing the beam, gradually enlarges towards the exit side. However, the acceleration efficiency will be lowered.

EXAMPLE 4

Example 4 is another embodiment of the third invention. In the embodiment 3, cooling of the shortcircuit plate 23 is not considered. In the embodiment 4, cooling pipes are welded to the shortcircuit plate 23. The cooling pipes lead to the outside of the cavity through the inner portions of the supporting rods 24. In this construction, the cooling can be performed when the necessary, which is not hampered by the moving of the shortcircuit plate 23.

Furthermore, in the embodiments 3 and 4, the split coaxial cavity is without the stem 8. However, this invention is applicable to the split coaxial cavity provided with the stem 8 with the similar effect.

EXAMPLE 5

Figure 9:
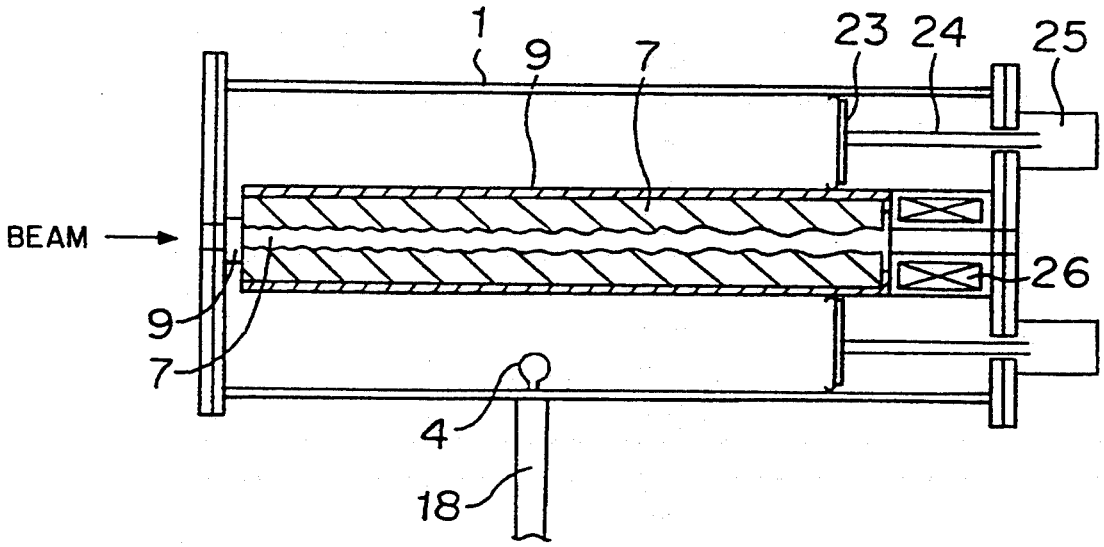
FIG. 9 is a sectional diagram showing an embodiment 5 of an energy-variable split coaxial RFQ cavity.

FIG. 9 is a sectional view of embodiment 5 of an energy-variable split coaxial RFQ according to the present invention. In FIG. 9, a numeral 26 designates a quadrupole electromagnet incorporated on the exit side of the cylindrical cavity 1. The other construction is the same as in the embodiment 3.

In the embodiment 4, since there is no electric field on the downstream side of the shortcircuit plate 23, the beam diverges and the beam size gradually increases. However, the beam can be converged by the quadrupole electromagnet 26.

Since the beam begins to diverge at the position wherein there is no electric field, the quadrupole electromagnet is effective to be installed as near as possible to back ends of the electrodes 7. Furthermore, when the quadrupole electromagnet is installed outside of the cavity, the quadrupole electromagnet is remote to the back ends of the electrodes due to an interference with a flange or the like and the effect is reduced.

EXAMPLE 6

The embodiment 6 is another embodiment of the first invention. In the embodiment 5, cooling of the shortcircuit plate 23 is not considered. In the embodiment 6, cooling pipes are welded to the shortcircuit plate 23. The cooling pipes lead to the outside of the cavity through the inner portions of the supporting rods 24. Therefore, the cooling is performed when necessary, without hampering to the moving of the shortcircuit plate 23.

Furthermore, in the embodiments 5 and 6, the split coaxial cavity is not provided with the stem 8. However, this invention is applicable to the split coaxial cavity provided with the stem 8 with the similar effect.

EXAMPLE 7

Figure 10A:
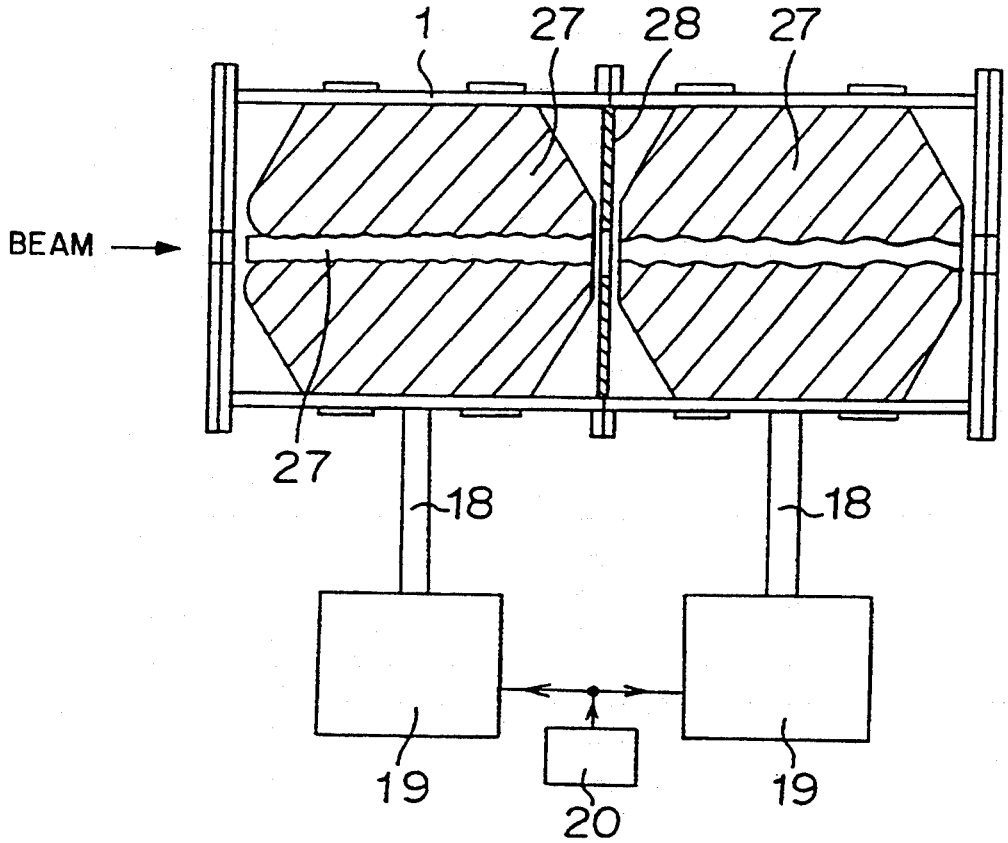
FIGS. 10(*a*) and 10(*b*) are a transverse sectional diagrams and a longitudinal sectional diagram showing an embodiment 7 of an energy-variable four-vane RFQ cavity according to the present invention.
Figure 10B:
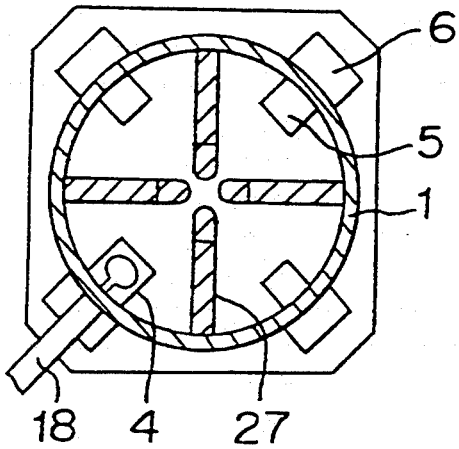

FIGS. 10(*a*) and 10(*b*) are respectively a transverse sectional diagram and a longitudinal sectional diagram showing an embodiment 7 of an energy-variable four-vane RFQ cavity. In the drawings, a numeral 27 designates a vane, the shape of the end portion of which is wavy in the longitudinal direction, and 28, a thin partition plate for separating the cylindrical cavity 1 in respect of a high-frequency wave. This partition plate 28 is provided with circulation holes as in the partition plate 16.

In the embodiment 7, the four vanes 27 are provided at angular intervals of 90° with respect to the axial line of the cylindrical cavity 1, at the inner wall face of the cylindrical cavity 1, extending in the axial direction. At the central portion thereof, the thin partition plate 28 is provided. The device has a structure wherein two sets of the four-vane RFQs are connected through the partition plate 28 while they are separated in respect of the high-frequency wave. Furthermore, the two sets of the four-vane RFQs are connected in respect of vacuum by the circulation holes provided at the partition plate 28. Furthermore, the partitioned cavities are respectively provided with the loop couplers 4. High-frequency powers are independently supplied to the respective loop couplers 4 through the signal generator 20, the high-frequency power amplifiers 19 and the coaxial waveguides 18.

In the embodiment 7 of the acceleration cavity, the alternating voltages having the same polarity are applied to a first pair of the opposing vanes, and the alternating voltages having the inverse polarity are applied to a second pair of the vanes, thereby generating the quadrupole electric field in the aperture surrounded by the four vanes 27 for passing the beam. The beam is converged and accelerated by this electric field under the same principle.

In the above embodiment 7, the partitioned cavities partitioned by the partition plate 28 are separated in respect of the high-frequency wave and supplied with independent high-frequency powers. Accordingly, the energy of the emitted beam can be changed under the same principle of the embodiment 2. Furthermore, the partitioned cavities are connected in a considerable vacuum conductance. Therefore, a single vacuum pump can create the vacuum. Since the boundary is composed of the thin partition plate 18, the device is inexpensive and compact.

In the embodiment 7, explanation has been given to the circular cavity 1 as the resonance cavity. However, the resonance cavity may be a rectangular cavity with the same effect.

Furthermore, in the above embodiment 7, explanation has been given to the case wherein the two high-frequency power amplifiers 19 are provided. However, this invention is not restricted by the number of the high-frequency power amplifiers, and the invention has the similar effect so far as the high-frequency powers supplied to the respective acceleration cavities are independently controlled.

Furthermore, in the above embodiment 7, explanation has been given to the construction wherein two sets of the four-vane acceleration cavities are connected. However, the invention has the similar effect so far as the number of the acceleration cavities is two or more.

According to the first aspect of this invention, the sectional-area-variable means for uniformly changing the electrical sectional area of the chamber, are provided to the respective chambers. Accordingly, the inductance L of the acceleration cavity can considerably be changed. The resonance frequency can considerably be changed. The energy can considerably be changed with respect to the same charged particles.

According to the second aspect of the present invention, the partition plate for electrically-partitioning the resonance cavity is provided for supplying independently the high-frequency powers to the respective partitioned cavities of the resonance cavities partitioned by the partition plate. Accordingly, the partitioned cavities of the resonance cavity are separated in respect of the high-frequency wave, and the electrode voltages are independently controlled in the respective partitioned cavities. The resonance cavity can be operated outside of the stable domain of the phase vibration by controlling the high-frequency power supplied to the partitioned cavity on the downstream side by the high-frequency power supplying means, by which the energy of the emitted beam becomes variable.

According to the third aspect of the present invention, the shortcircuit plate for shortcircuiting the electrodes with the inner wall face of the resonance cavity is provided which is movable in the axial direction of the resonance cavity. Accordingly, there is no high-frequency wave in the domain downstream from the shortcircuit plate, no electric field is generated among the electrodes in the domain and the charged particles are not accelerated. By changing the position of the shortcircuit plate, the effective length of the electrodes can be changed, thereby changing the energy of the emitted beam.

According to the fourth aspect of the present invention, the shortcircuit plate for shortcircuiting the electrodes with the inner wall face of the resonance cavity, is provided which is movable in the axial direction of the resonance cavity, and the quadrupole electromagnet is provided at the exit side of the resonance cavity. Therefore, the energy of the emitted beam becomes variable as in the third invention, and also the diverging charged particles emitted out of the electrodes can effectively be converged by the quadrupole electromagnet provided at the exit side of the resonance cavity.

According to the fifth aspect of this invention, the partition plate for electrical partitioning the resonance cavity is provided and the high-frequency power supplying means are provided for independently supplying the high-frequency powers to the respective partitioned cavities of the resonance cavity partitioned by the partition plate. Accordingly, the respective partitioned cavities of the resonance cavity partitioned by the partition plate are separated in respect of the high-frequency wave, and the vane voltage can independently be controlled for the respective partitioned cavities. The resonance cavity can be operated outside of the stable domain of the phase vibration by controlling the high-frequency power supply to the partitioned cavity on the downstream side by the high-frequency power supplying means, by which the energy of the emitted beam can be changed.

Figure 21A:
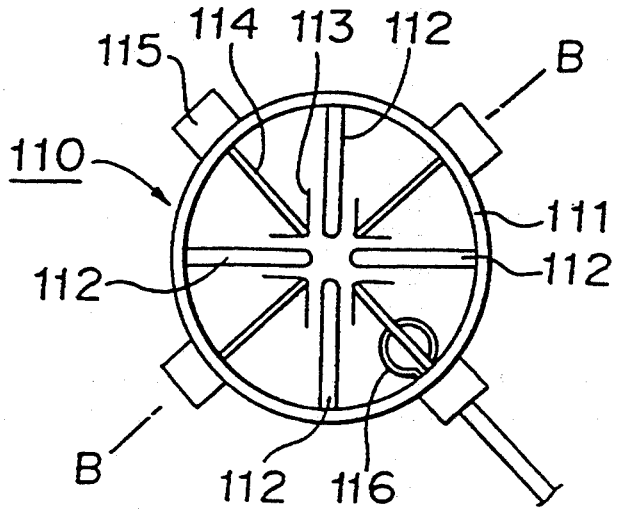
FIGS. 21(*a*) and 21(*b*) are diagrams for showing an eighth example of an energy-variable RFQ linac of this invention, wherein FIG. 21(*a*) is a sectional view orthogonal to the axial direction of the linac, and FIG. 21(*b*), a sectional diagram taken along the line B—B of the energy-variable RFQ linac shown in FIG. 21(*a*)
Figure 21B:
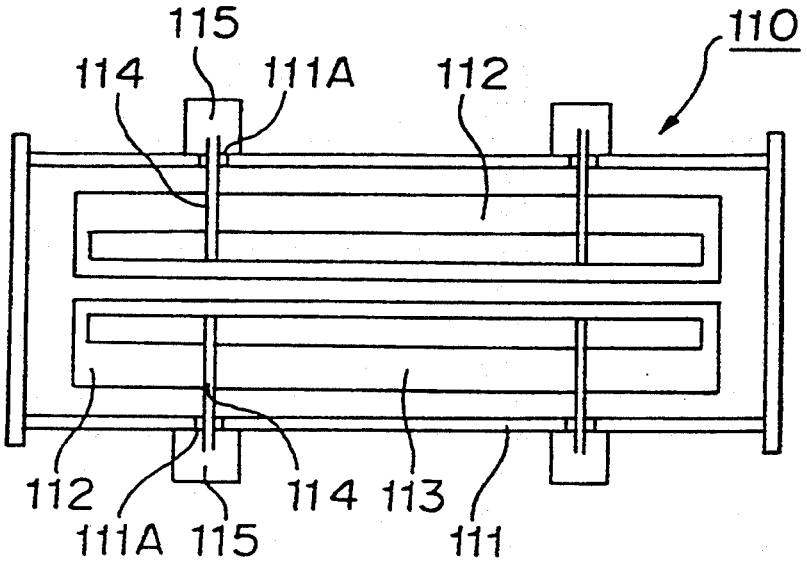
Figure 22A:
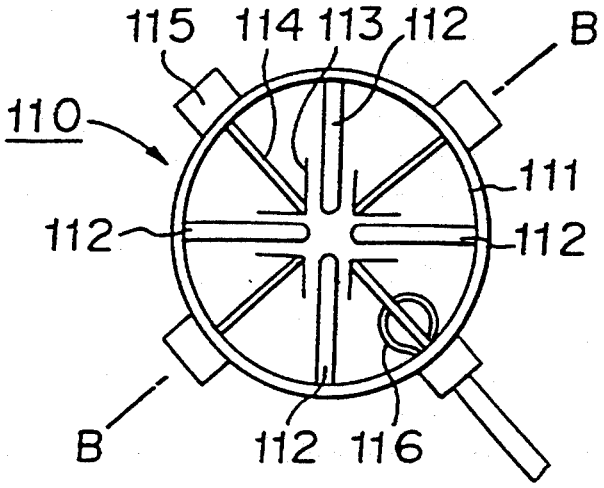
FIGS. 22(*a*) and 22( are diagrams showing a ninth embodiment of an energy-variable RFQ linac of this invention, wherein FIG. 22(*a*) corresponds to FIG. 21(*a*), FIG. 22(*b*), to FIG. 22(*b*).
Figure 22B:
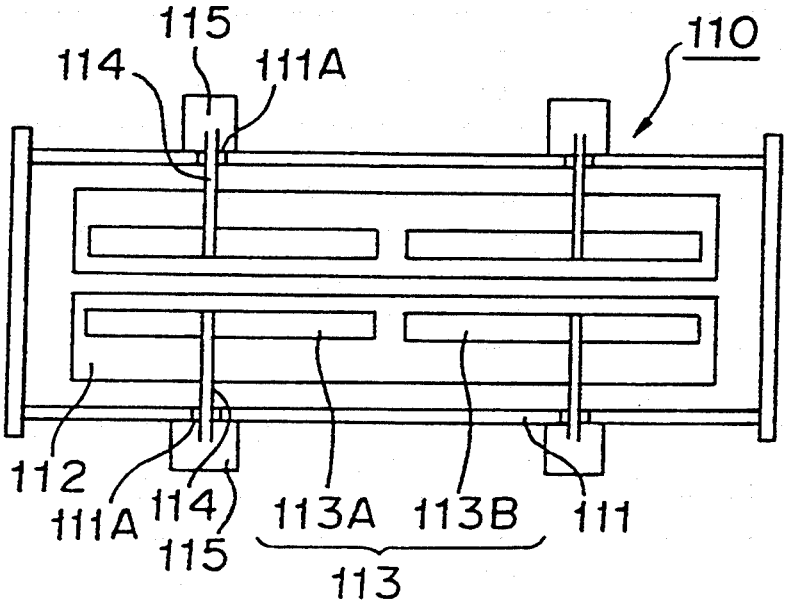

Next, explanation will be given to embodiments shown in FIGS. 21(*a*), 21(*b*), 22(*a*) and 22(*b*). FIGS. 21(*a*) and 21(*b*) are diagrams showing embodiment 8 of an energy-variable RFQ linac, FIG. 21(*a*) is a sectional diagram in the direction orthogonal to the axial direction, FIG. 21(*b*), a sectional diagram taken along the line B—B of the energy-variable RFQ linac shown in FIG. 21(*a*). FIGS. 22(*a*) and 22(*b*) are diagrams showing embodiment 9 of an energy-variable RFQ linac of this invention, wherein FIG. 22(*a*) is a diagram corresponding to FIG. 21(*a*), FIG. 22(*b*) to FIG. 21(*b*).

As shown in FIGS. 21(*a*) and 21(*b*), the embodiment of an energy-variable RFQ linac 110 is provided with four vanes 112 in a cylindrical resonance cavity 111, at peripherally equal intervals along the axial direction. In this energy-variable RFQ linac 110, four metal plates 13 as ground electrodes are provided extendably and retractably in the radial direction of the resonance cavity 111 along adjacent to end portions of the four respective vanes 112 which are juxtaposed in the peripheral direction of the resonance cavity 111. An equivalent capacitance C of the resonance cavity 111 can be increased and the capacitance C can be changed by extending and retracting the respective metal plates 113.

As shown in FIG. 21(*a*), sections orthogonal to the axial line, of the respective metal plates 113 each is formed in an angle-like shape showing a distorted L the corner portion of which is positioned between the end portions of the respective vanes 112 which are juxtaposed at four points in the peripheral direction of the resonance cavity 111. The respective face having an elongated shape is parallel to the end portion of the respective vane 111. The respective metal plate 113 is fixed to the ends of two supporting rods 114 extended through from the outside to the inside of two holes 111A which are formed at an peripheral face of the resonance cavity 111 at predetermined intervals. The respective supporting rods 114 are electrically connected to the resonance cavity 111. Driving mechanisms 115 for extending and retracting the metal plates 113 in the radial direction, are connected to the respective supporting rods 114. Furthermore, a numeral 116 designates a loop coupler for supplying a high-frequency power to the resonance cavity 111.

The emitted energy from the RFQ linac 110 is related to the resonance frequency of the acceleration cavity 111 as stated before. The resonance frequency is related to the intervane capacitance C between the end portions of the respective vanes 112. The capacitance C between the respective vanes 112 is inversely proportional to a gap length between the respective vanes 112. In this Example, the respective metal plates 113 are extended to the inward direction of the resonance cavity 111 by operating the respective driving mechanisms 115 thereby approaching the metal plates 113 opposing each other. The gap length between the respective vanes 112 is shortened equivalently and the capacitance C between the respective vanes 112 is enhanced. As a result of this operation, the resonance frequency of the acceleration cavity 111 can be varied and the emitted energy is variable.

Accordingly, in this embodiment, the emitted energy from RFQ linac 110 can arbitrarily changed by arbitrarily changing the gap lengths between the respective metal plates 113. Therefore, this RFQ linac can effectively be utilized as an independent accelerator such as an ion implantation device. In this embodiment, by respectively and finely adjusting the positions of the metal plates 113, the electromagnetic field distribution of the acceleration cavity or the resonance cavity 111 can be controlled. Therefore, the respective metal plates 113 can play the role of a side tuner.

EXAMPLE 9

In this embodiment of an energy-variable RFQ linac 110, the metal plate 113 having the elongated shape in the embodiment 8 is divided in two at the middle in the longitudinal direction. As shown in FIG. 22(*b*), the metal plate 113 is substituted by two metal plates 113A and 113B. The supporting rods 114 and the drive mechanisms 115 are connected to the respective metal plates 113A and 113B, by which the respective metal plates 113A and 113B are independently operated. Therefore, this invention has similar operation and effect as in Example 8.

EXAMPLE 10

In this embodiment of an energy-variable RFQ linac 110, the construction thereof is the same as that in Example 8 or Example 9 except a cooling device, not shown. When cooling is necessary, the respective metal plates 113 or 113A and 113B are cooled by the cooling device. This cooling device is provided with first cooing pipes provided along the back face side of the metal plate 113, or 113A and 113B and second cooling pipes which are connected to the first cooling pipes passing through the hollow supporting rods 114. The second cooling pipes lead to outside of the resonance cavity 111 and a coolant from outside is circulated in the respective cooling pipes thereby cooling the metal plate 113 and restraining temperature elevation of the metal plates 113 or the like.

This invention is not restricted by the above embodiments and this invention includes any construction so far as the emitted energy from the accelerator is made variable by providing metal plates which are extendable and retractable in the radial direction of a resonance cavity.

As explained as above, according to this invention, the equivalent capacitance in the resonance cavity is made variable by providing the metal plates which are extendable and retractable in the radial direction of the resonance cavity. Therefore, this invention can provide the four-vane RFQ linac capable of arbitrarily changing the energy of the charged particle beam emitted from the accelerator.

What is claimed is:

1. An energy-variable split coaxial RFQ linac wherein four electrodes thereof are inner conductors in a coaxial cavity, characterized in that a cavity thereof is partitioned by conductive plates, high-frequency powers are independently supplied to respective partitioned cavities and the high-frequency power supplied to the partitioned cavity at an exit side thereof is controlled thereby controlling energy of a beam emitted from the exit side.

2. An energy-variable four-vane RFQ linac attached with four electrodes (vanes) at angular intervals of 90° in a resonance cavity thereof having a square or circular sectional shape, characterized in that the resonance cavity is partitioned by thin partition plates, high-frequency powers are supplied to respective partitioned cavities and the high-frequency power supplied to the partitioned cavity at an exit side thereof is controlled thereby controlling energy of a beam emitted from the exit side.

3. A method of accelerating a charged particle beam transmitted through a resonator, comprising the steps of;

A. partitioning the resonator into at least a first cavity and a second cavity;

B. generating a first accelerated beam in the first cavity by generating a first electromagnetic field in the first cavity to accelerate the charged particle beam; and C. generating a second accelerated beam in the second cavity by generating a second electromagnetic field in the second cavity to accelerate the first accelerated beam, the second electromagnetic field being different from the first electromagnetic field.

4. A method of accelerating a charged particle beam transmitted through a resonator, comprising the steps of:

A. partitioning the resonator into at least a first cavity and a second cavity;

B. generating a first accelerated beam in the first cavity by disposing at least one first conductive element in the first cavity and supplying a first high frequency power to the first cavity to generate a first electromagnetic field in the first cavity that accelerates the charged particle beam; and C. generating a second accelerated beam in the second cavity by disposing at least one second conductive element in the second cavity and supplying a second high frequency power to the second cavity to generate a second electromagnetic field in the second cavity that accelerates the first accelerated beam.

5. A method for accelerating an electromagnetic beam transmitted through an accelerator, the method comprising the steps of:

exposing the electromagnetic beam to a first electromagnetic field in the accelerator to generate a first accelerated beam; and exposing the first accelerated beam to a second electromagnetic field in the accelerator to generate a second accelerated beam, the second electromagnetic field being different from the first electromagnetic field.

6. The method of claim 5, further comprising the step of varying the second electromagnetic field.

7. An energy-variable RFQ linac for accelerating a charged particle beam, comprising:

a resonator having an entrance side and an exit side;

at least one partition plate that partitions the resonator into at least a first cavity and a second cavity;

a first power transmitter arranged to transmit a first power signal into the first cavity;

a second power transmitter arranged to transmit a second power signal into the second cavity;

a first electromagnetic field generator having at least one first conductive element disposed within the first cavity, the at least one first conductive element generating a first electromagnetic field in response to the first power signal;

a second electromagnetic field generator having at least one second conductive element disposed within the second cavity, the at least one second conductive element generating a second electromagnetic field in response to the second power signal;

wherein the first power transmitter includes a first loop coupler and the second power transmitter includes a second loop coupler; and wherein the first power transmitter further includes a first high frequency amplifier and a first coaxial waveguide coupled between the first high frequency amplifier and the first loop coupler.

8. The energy variable RFQ linac of claim 7 wherein the second power transmitter further includes a second high frequency amplifier and a second coaxial waveguide coupled between the second high frequency amplifier and the second loop coupler.

9. The energy-variable RFQ linac of claim 7, wherein the energy-variable RFQ linac is a four-vane energy-variable RFQ linac, with four electrodes (vanes) at angular intervals of 90 degrees with a resonance cavity thereof having a square or circular sectional shape.

10. An energy-variable RFQ linac for accelerating a charged particle beam, comprising:

a resonator having an entrance side and an exit side;

at least one partition plate that partitions the resonator into at least a first cavity and a second cavity;

a first power transmitter arranged to transmit a first power signal into the first cavity;

a second power transmitter arranged to transmit a second power signal into the second cavity;

a first electromagnetic field generator having at least one first conductive element disposed within the first cavity, the at least one first conductive element generating a first electromagnetic field in response to the first power signal;

a second electromagnetic field generator having at least one second conductive element disposed within the second cavity, the at least one second conductive element generating a second electromagnetic field in response to the second power signal; and means, coupled to the first and second power transmitters, for independently controlling the first and second power signals.

11. The energy variable RFQ linac of claim 10, wherein the first power transmitter includes a first loop coupler, the second power transmitter includes a second loop coupler, and the first power transmitter includes a first high frequency amplifier and a first coaxial waveguide coupled between the first high frequency amplifier and the first loop coupler.

12. The energy-variable RFQ linac of claim 10, wherein the energy-variable RFQ linac is a four-vane energy-variable RFQ linac, with four electrodes (vanes) at angular intervals of 90 degrees with a resonance cavity thereof having a square or circular sectional shape.

13. An energy-variable RFQ linac for accelerating a charged particle beam, comprising:

a resonator having an entrance side and an exit side;

at least one partition plate that partitions the resonator into at least a first cavity and a second cavity;

a first power transmitter arranged to transmit a first power signal into the first cavity;

a second power transmitter arranged to transmit a second power signal into the second cavity;

a first electromagnetic field generator having at least one first conductive element disposed within the first cavity, the at least one first conductive element generating a first electromagnetic field in response to the first power signal; and a second electromagnetic field generator having at least one second conductive element disposed within the second cavity, the at least one second conductive element generating a second electromagnetic field in response to the second power signal;

wherein the second power transmitter and the second electromagnetic field generator are constructed and arranged so that the second electromagnetic field is different from the first electromagnetic field.

14. The energy-variable RFQ linac of claim 13, wherein:

the entrance and exit sides each include a wall having an aperture;

the resonator includes a longitudinal axial path extending through its length from the entrance side aperture to the exit side aperture; and the at least one first conductive element includes four first electrodes orthogonally disposed around the longitudinal axial path, and the at least one second conductive element includes four second electrodes orthogonally disposed around the longitudinal axial path.

15. The energy-variable RFQ linac of claim 13, wherein the second power transmitter and the second electromagnetic field generator are constructed and arranged so that the second electromagnetic field is of different magnitude than the first electromagnetic field.

16. An energy-variable RFQ linac for accelerating a charged particle beam, comprising:

a resonator having an entrance side and an exit side;

at least one partition plate that partitions the resonator into at least a first cavity and a second cavity;

a first electromagnetic field generator for generating a first electromagnetic field in the first cavity;

a second electromagnetic field generator for generating a second electromagnetic field in the second cavity; and means for controlling the first and second electromagnetic field generators so that the first electromagnetic field is different from the second electromagnetic field.

17. The energy-variable RFQ linac of claim 16, wherein:

the entrance and exit sides each include a wall having an aperture;

the resonator includes a longitudinal axial path extending through its length from the entrance side aperture to the exit side aperture; and the first electromagnetic field generator includes four first electrodes orthogonally disposed around the longitudinal axial path, and the second electromagnetic field generator includes four second electrodes orthogonally disposed around the longitudinal axial path.

18. The energy-variable RFQ linac of claim 16, wherein the means for controlling includes means for controlling the first and second electromagnetic field generators so that the first electromagnetic field is of different magnitude than the second electromagnetic field.

19. An energy-variable RFQ linac for accelerating a charged particle beam, comprising:

a resonator having an entrance side and an exit side;

at least one partition plate that partitions the resonator into at least a first cavity and a second cavity;

a first power transmitter arranged to transmit a first power signal into the first cavity;

a second power transmitter arranged to transmit a second power signal into the second cavity, the second power transmitter being controlled independently from the first power transmitter;

a first electromagnetic field generator having at least one first conductive element disposed within the first cavity, the at least one first conductive element generating a first electromagnetic field in response to the first power signal; and a second electromagnetic field generator having at least one second conductive element disposed within the second cavity, the at least one second conductive element generating a second electromagnetic field in response to the second power signal.

20. The energy-variable RFQ linac of claim 19, further comprising a controller, connected to the second power transmitter, for independently controlling the second power transmitter.

21. The energy-variable RFQ linac of claim 19, further comprising means for independently controlling the second power transmitter.

22. The energy-variable RFQ linac of claim 19, wherein:

the entrance and exit sides each include a wall having an aperture;

the resonator includes a longitudinal axial path extending through its length from the entrance side aperture to the exit side aperture; and the at least one first conductive element includes four first electrodes orthogonally disposed around the longitudinal axial path, and the at least one second conductive element includes four second electrodes orthogonally disposed around the longitudinal axial path.

23. An energy-variable RFQ linac for accelerating a charged particle beam, comprising:

a resonator having an entrance side and an exit side;

at least one partition plate that partitions the resonator into at least a first cavity and a second cavity;

a first power transmitter arranged to transmit a first power signal into the first cavity;

a second power transmitter arranged to transmit a second power signal into the second cavity, the second power signal being different from the first power signal,;

a first electromagnetic field generator having at least one first conductive element disposed within the first cavity, the at least one first conductive element generating a first electromagnetic field in response to the first power signal; and a second electromagnetic field generator having at least one second conductive element disposed within the second cavity, the at least one second conductive element generating a second electromagnetic field in response to the second power signal.

24. The energy-variable RFQ linac of claim 23, wherein:

the first cavity is defined by the entrance side of the resonator and the partition plate; and the second cavity is defined by the partition plate and the exit side of the resonator.

25. The energy variable RFQ linac of claim 23, wherein:

the entrance and exit sides each include a wall having an aperture; and the resonator includes a longitudinal axial path extending through its length from the entrance side aperture to the exit side aperture.

26. The energy variable RFQ linac of claim 23, wherein the first power transmitter includes a first loop coupler and the second power transmitter includes a second loop coupler.

27. The energy-variable RFQ linac of claim 23, wherein the second power transmitter is variable, to vary the second power signal.

28. The energy-variable RFQ linac of claim 23, wherein:

the entrance and exit sides each include a wall having an aperture;

the resonator includes a longitudinal axial path extending through its length from the entrance side aperture to the exit side aperture; and the at least one first conductive element includes four first electrodes orthogonally disposed around the longitudinal axial path, and the at least one second conductive element includes four second electrodes orthogonally disposed around the longitudinal axial path.

29. The energy-variable RFQ linac of claim 23, wherein the second power signal is of different magnitude than the first power signal.

30. An energy-variable RFQ linac for accelerating a charged particle beam, comprising:

a resonator having an entrance side and an exit side;

at least one partition plate that partitions the resonator into at least a first cavity and a second cavity;

a first power transmitter arranged to transmit a first power signal into the first cavity;

a second power transmitter arranged to transmit a second power signal into the second cavity;

a first electromagnetic field generator having at least one first conductive element disposed within the first cavity, the at least one first conductive element generating a first electromagnetic field in response to the first power signal;

a second electromagnetic field generator having at least one second conductive element disposed within the second cavity, the at least one second conductive element generating a second electromagnetic field in response to the second power signal;

wherein the entrance and exit sides each include a wall having an aperture;

wherein the resonator includes a longitudinal axial path extending through its length from the entrance side aperture to the exit side aperture; and wherein the at least one first conductive element includes four first electrodes orthogonally disposed around the longitudinal axial path, and the at least one second conductive element includes four second electrodes orthogonally disposed around the longitudinal axial path.

31. The energy variable RFQ linac of claim 30, wherein the first power transmitter includes a first loop coupler, the second power transmitter includes a second loop coupler, and the first power transmitter includes a first high frequency amplifier and a first coaxial waveguide coupled between the first high frequency amplifier and the first loop coupler.

32. The energy variable RFQ linac of claim 30, further comprising means, coupled to the first and second power transmitters, for independently controlling the first and second power signals.

33. The energy-variable RFQ linac of claim 30, wherein the energy-variable RFQ linac is a four-vane energy-variable RFQ linac, with four electrodes (vanes) at angular intervals of 90 degrees with a resonance cavity thereof having a square or circular sectional shape.

34. The energy variable RFQ linac of claim 30, wherein the resonator includes walls extending along its length from the entrance side to the exit side, and wherein the resonator further comprises a stem, disposed within the first cavity and coupled to the resonator walls, the stem supporting at least one of the four first electrodes.

35. The energy variable RFQ linac of claim 34, wherein of the four first electrodes, a first pair is coupled between the entrance side wall and the partition plate, and a second pair is coupled to the stem.

36. The energy variable RFQ linac of claim 35, wherein of the four second electrodes, a first pair is coupled to the partition plate, and a second pair is coupled to the exit side wall.

* * * * *

UNITED STATES PATENT AND TRADEMARK OFFICE
CERTIFICATE OF CORRECTION

PATENT NO. : 5,440,203

DATED : August 8, 1995

INVENTOR(S) : Tetsuya Nakanishi

It is certified that error appears in the above-identified patent and that said Letters Patent is hereby corrected as shown below:

On the title page, item

[30] Foreign Application Priority Data, please add:

"April 30, 1992 [JP] Japan 111532/1992"

Signed and Sealed this

Second Day of April, 1996

Bruce Lehman

*Attest:*

BRUCE LEHMAN

*Attesting Officer*

*Commissioner of Patents and Trademarks*